US005353926A

United States Patent [19]

Yeh

[11] Patent Number: 5,353,926

[45] Date of Patent: Oct. 11, 1994

[54] MUG AND COASTER ASSEMBLY

[76] Inventor: Frank Yeh, 1019 N. Mayflower St., Anaheim, Calif. 92801

[21] Appl. No.: 155,575

[22] Filed: Nov. 19, 1993

[51] Int. Cl.[5] ..... B65D 23/08

[52] U.S. Cl. ..... 206/217; 215/100.5; 220/23.83; 248/346.1

[58] Field of Search ..... 206/217; 215/100 R, 215/100.5; 220/23.83, 23.86, 574; 248/346.1

[56] References Cited

U.S. PATENT DOCUMENTS

| | | | |
|---|---|---|---|
| 1,957,263 | 5/1934 | Gray . | |
| 2,205,687 | 6/1940 | Elsaesser | 215/100.5 |
| 2,641,911 | 6/1953 | Raymond et al. . | |
| 2,641,991 | 6/1953 | Wilcox . | |
| 2,727,645 | 12/1955 | Dore . | |
| 2,963,256 | 12/1960 | Borah . | |
| 3,079,037 | 2/1963 | Schechter | 215/100.5 |
| 3,357,590 | 12/1967 | Safford | 215/100.5 |
| 3,526,335 | 9/1970 | Swett et al. | 220/23.83 |
| 3,945,491 | 3/1976 | Lindenbaum | 215/100 R |
| 4,040,549 | 8/1977 | Sadler . | |
| 4,591,066 | 5/1986 | Moen . | |
| 4,756,497 | 7/1988 | Lan . | |
| 4,775,063 | 10/1988 | Godfrey . | |
| 4,907,712 | 3/1990 | Stempin . | |
| 5,056,749 | 10/1991 | Ige . | |

FOREIGN PATENT DOCUMENTS

| | | | |
|---|---|---|---|
| 0191611 | 1/1923 | United Kingdom | 215/100.5 |
| 0978565 | 12/1964 | United Kingdom | 220/23.83 |

*Primary Examiner*—Jimmy G. Foster
*Attorney, Agent, or Firm*—Raymond Sun

[57] ABSTRACT

A coaster and mug assembly comprises a coaster and a mug. The coaster comprises a flat bottom and a resilient and flexible annular side wall formed integrally with the flat bottom and extending radially outwardly at an angle from the flat bottom and terminating at a resilient annular lip, the annular lip extending radially inwardly from the side wall. The mug comprises a bottom and a lower annular side wall extending radially outwardly at an angle from the bottom of the mug and terminating at a bend where it is integrally connected with an annular upper side wall, the annular upper side wall extending radially inwardly at an angle from the bend. The mug is snugly fitted inside the coaster with the annular lip of the coaster resiliently gripping the bend of the mug to hold the coaster securely to the mug. The coaster may be removed from the mug by lifting the resilient annular lip of the coaster and peeling it from the mug.

11 Claims, 1 Drawing Sheet

MUG AND COASTER ASSEMBLY

BACKGROUND OF THE INVENTION

1. Field Of The Invention

The present invention relates to a mug and coaster assembly, and in particular, to a coaster that is adapted to be secured to a mug to prevent condensate, moisture and overflow liquid from contacting the supporting surface on which the mug and coaster assembly rests.

2. Description Of The Related Art

The present invention is applicable to mugs, glasses, receptacles and beverage containers alike, which shall hereinafter be collectively and interchangeably referred to as either "mugs" or "receptacles". The present invention shall be described hereinbelow in connection with a mug, although it will be appreciated that the principles of the present invention are also applicable to other similarly configured receptacles and beverage containers, such as glasses, for example.

There are many coasters that are provided for use with mugs to protect table surfaces or other supporting surfaces from condensate, moisture and overflowing liquid which may gravitate to the bottom of the mugs. Many of these coasters have also been adapted to be secured to the bottom of the mug so that the mug will not slide or slip off the coaster when used, for example, in an automobile. When so used, a user may lift up the coaster and the mug together when drinking, and then place the combined coaster and mug back on the dashboard after drinking. This allows the driver to keep his or her eye on the road without needing to look at the coaster to secure the mug to the coaster. Some of these coasters have also attempted to retain the coaster in a fixed position on the supporting surface.

One example is shown in U.S. Pat. No. 2,641,911 to Raymond et al., which discloses a coaster 10 which is not attached to the drinking glass 11. The drinking glass 11 is free to move and can be easily toppled.

Another example is shown in U.S. Pat. No. 1,957,263 to Gray, which discloses, in FIG. 3, a coaster having a body 30 that has a wall 34 with a bead 36 formed around the upper edge. Gripping tongues 38 present a substantially continuous inwardly directed flange which frictionally engages the receptacle 40. However, depending upon the configuration of the receptacle 40, the coaster of the '263 Gray patent is not always adequately attached to the receptacle 40, and does not provide means to adequately hold the coaster to the supporting surface.

A recent example is U.S. Pat. No. 5,056,749 to Ige, which discloses a coaster 10 that is adapted to be attached to a recessed cylindrical portion 32 of a cup 30. The '749 Ige patent also teaches that the coaster 10 be made of a material such that its bottom surface can frictionally grip a supporting surface. However, the coaster 10 of the '749 Ige patent does not prevent condensate, moisture and overflowing liquid from reaching the supporting surface since the outer surface 16 of the side wall 12 is flush with the outer surface of the upper portion 34 of the cup 30. Also, it would be undesirable to use the cup 30 without the coaster 10 since the recessed cylindrical portion 32 is aesthetically unsightly. Further, the mere use of a material which frictionally grips the supporting surface may not be adequate on its own to hold the coaster 10 to certain supporting surfaces, such as to automobile dashboards which experience significant movement.

Thus, the above-described coaster and mug combinations each suffer from certain drawbacks. Thus, there still exists a need for a coaster and mug combination: (1) in which the coaster strongly grips the mug and yet the mug can be easily removed from the coaster and easily reinserted in a secure manner in the coaster, (2) where the coaster provides a trap for catching condensation, moisture and overflowing liquid which forms and drains down the side of the mug to prevent such moisture or liquid from reaching the supporting surface, (3) in which the coaster has means for holding the coaster to the supporting surface, (4) which looks aesthetically attractive when used in combination and when used as separate components, and (5) which can be manufactured at low cost to the consumer.

SUMMARY OF THE INVENTION

The objects of the present invention may be achieved by providing a coaster and mug assembly, the assembly comprising a coaster and a mug. The coaster comprises a flat bottom having an outer edge, and a plurality of openings spaced apart around the flat bottom, the flat bottom further comprising a plurality of protrusions disposed on the lower surface of the flat bottom for providing frictional engagement with a supporting surface. The coaster further comprises a resilient and flexible annular side wall formed integrally with the outer edge of the flat bottom, the side wall extending radially outwardly at an angle from the outer edge of the flat bottom and terminating at a resilient annular lip, the annular lip extending radially inwardly from the side wall. The annular side wall comprises an outer surface having a plurality of ribs provided thereon. The mug comprises a bottom and a lower annular side wall extending radially outwardly at an angle from the bottom of the mug and terminating at a bend where it is integrally connected with an annular upper side wall, the annular upper side wall extending radially inwardly at an angle from the bend. The mug is snugly fitted inside the coaster with the annular lip of the coaster resiliently gripping the bend of the mug to hold the coaster securely to the mug. The coaster may be removed from the mug by lifting the resilient annular lip of the coaster and peeling it from the mug.

Therefore, the coaster and mug combination according to the present invention is configured so that a lip of the coaster strongly grips the mug, yet the mug can be easily removed from the coaster by simply peeling the lip, and can be easily reinserted in a secure manner in the coaster by pressing the mug downwardly into the coaster so that the bottom portion of the mug fits snugly in the interior of the coaster. The lip of the coaster provides a trap for catching condensation, moisture and overflowing liquid which forms and drains down the side of the mug to prevent such moisture or liquid from reaching the supporting surface. Further, the coaster has a plurality of T-shaped protrusions which improve the frictional engagement of the bottom surface of the coaster to the supporting surface. The coaster and mug combination appears aesthetically attractive when used together, or even when used as separate components. The simplicity of the structure of the coaster and mug assembly allows it to be manufactured at low cost to the consumer.

DESCRIPTION OF THE PREFERRED EMBODIMENTS

Figure 1:
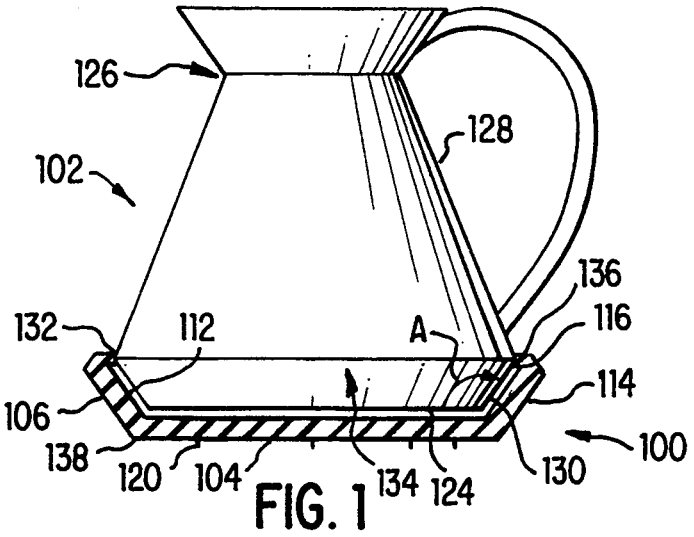
FIG. 1 is a cross-sectional view showing a mug used with a coaster in accordance with an exemplary embodiment of the present invention.
Figure 2:
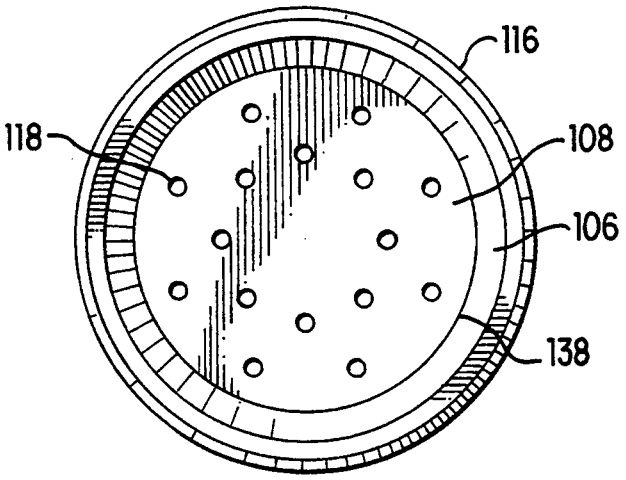
FIG. 2 is a top plan view of the coaster of FIG. 1.
Figure 4:
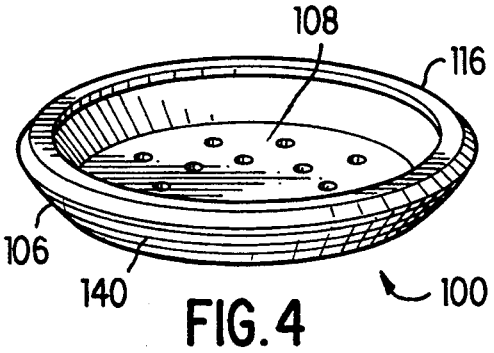
FIG. 4 is a perspective view of the coaster of FIG. 1.
Figure 3:
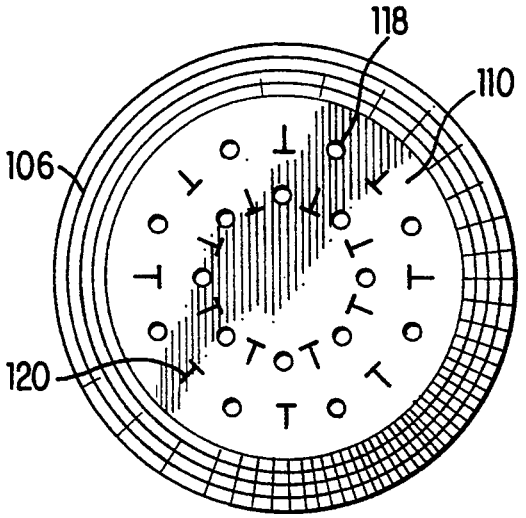
FIG. 3 is a bottom plan view of the coaster of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIGS. 1–4, the coaster and mug combination according to a preferred embodiment of the present invention comprises a coaster 100 adapted for use with a mug 102. The coaster is preferably made of a resilient and flexible material, such as rubber, polyethylene, or silicon rubber. The coaster 100 comprises a circular flat bottom 104 that is integrally formed at an outer edge 138 with an angled annular side wall 106. The annular side wall 106 comprises an inner surface 112 and a ribbed outer surface 114 that is provided with a plurality of ribs 140 (see FIG. 4). The side wall 106 extends radially outwardly at an angle A from the outer edge 138 of the flat bottom 104 and terminates at an annular lip 116 which extends radially inwardly from the side wall 106. The angle A formed between the bottom 104 and the side wall 106 is preferably between 90 and 120 degrees, and most preferably, about 100 degrees.

The flat bottom 104 has an upper surface 108 and a lower surface 110. A plurality of openings 118 are provided in the flat bottom 104 to allow air to enter into the interior of the coaster 100 when the mug 102 is fitted therein. This prevents the production of any forces which may cause the bottom 124 of the mug 102 to stick to the upper surface 108 of the bottom 104 of the coaster 100. The lower surface 110 is also provided with a plurality of T-shaped protrusions 120. The type of material of the coaster 100 provides some frictional engagement with the supporting surface, but the T-shaped protrusions provide additional friction contact with the supporting surface for improved stability and hold.

The mug 102 comprises a bottom 124 and a lower annular side wall 130 which extends radially outwardly at an angle from the bottom 124 to a bend 132 where it integrally connects with one end of an upper annular side wall 128. The angle between the bottom 124 and the lower side wall 130 is preferably similar to that angle between the bottom 104 and the side wall 106 of the coaster 100 to allow the bottom portion 134 of the mug 102 to be snugly fitted in the coaster 100, as explained in greater detail hereinbelow. The upper side wall 128 in turn extends radially inwardly at an angle so that the neck 126 has a diameter which is smaller than the diameter of the bottom portion 134. The mug 102 may be any conventional liquid container or mug, such as a mug made of ceramic, porcelain or other similar material, or a glass.

As shown in FIG. 1, the mug 102 is snugly fitted in the coaster 100 such that the bottom 124 of the mug 102 is fitted against the upper surface 108 of the flat bottom 104 of the coaster 100. The angled lower side wall 130 of the mug 102 fits snugly against the inner surface 112 of the annular side wall 106 of the coaster 100. The lip 116 is fitted over the bend 132 of the mug 102 to provide an attachment mechanism which securely holds the coaster 100 to the bottom portion 134 of the mug 102.

In operation, the coaster 100 may be conveniently removed from the mug 102 by inserting a finger between the mug 102 and the lip 116, lifting the lip 116 from the bend 132, and peeling it off the mug 102. Since the coaster 100 is made from a resilient and flexible material, the removal can be effected quite easily. To insert the bottom portion 134 of the mug 102 back into the coaster 100, the user merely presses the bottom portion 134 of the mug 102 downwardly into the coaster 100, and the flexible and resilient annular side wall 106 and lip 116 of the coaster 100 will easily receive the bottom portion 134 of the mug 102 and grip it snugly at the bend 132 to hold it in place.

The lip 116 itself has a flat upper surface 136 which is preferably wide enough to catch and collect any condensation, moisture or liquid which flows down the upper side wall 128 of the mug 102. The ribs 140 function to retain any excess moisture or liquid that may spill over the upper surface 136 of the lip 116 to provide additional safeguard against moisture or liquid contacting the supporting surface. The user may then use a towel or napkin to absorb and/or wipe off the moisture and liquid collected at the upper surface 136 or at the ribs 140.

It will be appreciated that the combined mug and coaster according to the present invention can be provided in any shape or size as long as both are configured similarly so that one can be adapted for use with the other. For example, the coaster 100 and mug 102 shown in FIGS. 1–4 are circular, but they may also be provided in larger or smaller sizes and in other shapes, such as oval, square, triangular or polygonal.

Therefore, the coaster and mug combination according to the present invention is configured so that the coaster 100, through the configuration and resiliency of its annular lip 116, strongly grips the mug 102 at its bend 132. The mug 102 can be easily removed from the coaster 100 by simply peeling the lip 116, and can be easily reinserted in a secure manner in the coaster 100 by pressing the mug 102 downwardly into the coaster 100 so that the bottom portion 134 of the mug 102 fits snugly in the interior of the coaster 100. The lip 116 of the coaster 100 provides a trap for catching condensation, moisture and overflowing liquid which forms and drains down the upper side wall 128 of the mug 102 to prevent such moisture or liquid from reaching the supporting surface, and the ribs 140 provide additional protection. Further, the coaster 100 has a plurality of T-shaped protrusions 120 which improve the frictional engagement of the lower surface 110 of the coaster 100 to the supporting surface. The coaster and mug combination has an aesthetically appealing streamlined configuration, regardless of whether they are used together, or are used as separate components. The simplicity of the structures of the coaster 100 and the mug 102 render them easy and inexpensive to manufacture.

While the description above refers to particular embodiments of the present invention, it will be understood that many modifications may be made without department from the spirit thereof.

What is claimed is:

1. A coaster adapted to be removably attached to a receptacle, the coaster comprising:

a flat bottom, the flat bottom comprising an outer edge, an upper surface, a lower surface, and a plurality of openings spaced apart around the flat bottom, the flat bottom further comprising a plurality of protrusions disposed on the lower surface for providing frictional engagement with a supporting surface; and a straight, resilient and flexible annular side wall formed integrally with the outer edge of the flat bottom, the side wall extending radially outwardly at an angle from the outer edge of the flat bottom and terminating at a resilient annular lip, the annular lip extending radially inwardly from the side wall.

2. The coaster of claim 1, wherein the annular side wall comprises an outer surface having a plurality of ribs provided thereon.

3. The coaster of claim 1, wherein the annular side wall extends radially outwardly from the outer edge of the flat bottom at an angle of about 100 degrees.

4. The coaster of claim 1, wherein the coaster is made from rubber.

5. A coaster and receptacle assembly, the assembly comprising:

(a) a coaster, the coaster comprising:

(i) a flat bottom, the flat bottom comprising an outer edge, an upper surface, and a lower surface; and (ii) a straight, resilient and flexible annular side wall formed integrally with the outer edge of the flat bottom, the side wall having an inner surface and outer surface, the annular side wall extending radially outwardly at an angle from the outer edge of the flat bottom and terminating at a resilient annular lip, the annular lip extending radially inwardly from the side wall; and (b) a receptacle, the receptacle comprising a bottom and a lower straight, annular side wall extending radially outwardly at an angle from the bottom of the receptacle and terminating at a bend where it is integrally connected with an annular upper side wall, the annular upper side wall extending radially inwardly at an angle from the bend;

(c) wherein the receptacle is snugly fitted inside the coaster with the annular lip of the coaster resiliently gripping the bend of the receptacle to hold the coaster securely to the receptacle.

6. The assembly of claim 5, wherein the coaster further comprises a plurality of openings spaced apart around the flat bottom.

7. The assembly of claim 6, wherein the coaster further comprises a plurality of protrusions disposed on the lower surface of the flat bottom for providing frictional engagement with a supporting surface.

8. The assembly of claim 5, wherein the coaster may be removed from the receptacle by lifting the resilient annular lip of the coaster and peeling it from the receptacle.

9. The assembly of claim 5, wherein the annular side wall of the coaster comprises an outer surface having a plurality of ribs provided thereon.

10. The assembly of claim 5, wherein the annular side wall of the coaster extends radially outwardly from the outer edge of the flat bottom at an angle of about 100 degrees.

11. The assembly of claim 5, wherein the coaster is made from rubber.

* * * * *